US007780003B2

(12) United States Patent
Harrelson

(10) Patent No.: US 7,780,003 B2
(45) **Date of Patent: *Aug. 24, 2010**

(54) DISPENSING SYSTEM FOR DOUBLE STACK CARTON

(75) Inventor: Glen R. Harrelson, Gainesville, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/274,477

(22) Filed: Nov. 20, 2008

(65) Prior Publication Data

US 2009/0065388 A1 Mar. 12, 2009

Related U.S. Application Data

(63) Continuation of application No. 11/558,717, filed on Nov. 10, 2006, now Pat. No. 7,467,713, which is a continuation of application No. 11/139,827, filed on May 27, 2005, now Pat. No. 7,134,551, which is a continuation of application No. 10/365,148, filed on Feb. 12, 2003, now Pat. No. 6,918,487.

(51) Int. Cl.

| | |
|---|---|
| ***B65D 75/00*** | (2006.01) |
| ***B65D 17/00*** | (2006.01) |
| ***A47F 1/04*** | (2006.01) |

(52) U.S. Cl. ..... 206/427; 221/305; 229/122; 229/242

(58) Field of Classification Search ..... 206/427–429; 221/305; 229/121–122, 235, 240, 242, 244
See application file for complete search history.

(56) References Cited

U.S. PATENT DOCUMENTS

| | | | | |
|---|---|---|---|---|
| 1,925,102 | A | | 9/1933 | Levkoff |
| 2,115,673 | A | | 4/1938 | Stompe |
| 2,868,431 | A | * | 1/1959 | Painter ..... 206/427 |
| 3,178,242 | A | | 4/1965 | Ellis et al. |
| 3,228,582 | A | | 1/1966 | Osberg |
| 3,265,283 | A | | 8/1966 | Farquhar |
| 3,356,279 | A | | 12/1967 | Root |
| 3,540,581 | A | | 11/1970 | Koolnis |

(Continued)

FOREIGN PATENT DOCUMENTS

| | | |
|---|---|---|
| EP | 1 615 839 B1 | 1/2010 |

(Continued)

*Primary Examiner*—Bryon P Gehman
(74) *Attorney, Agent, or Firm*—Womble Carlyle Sandridge & Rice, PLLC

(57) ABSTRACT

The carton of this invention is capable of carrying the plurality of containers stacked upon their ends in two tiers with a unique dispenser that permits the dispensing of containers on their sides. The dispenser is formed in a top side wall and extends into the end wall with most of the end wall being torn open but leaving a portion near the bottom side wall to prevent the bottom layer of containers from rolling out. Angled projections in the dispensing end of the carton near the top panel and bottom panel prevent the top layer of containers from rolling out. A divider may be inserted between the two tiers of containers to facilitate loading the carton and preventing the containers from accidentally rolling out when the dispenser is open.

33 Claims, 4 Drawing Sheets

U.S. PATENT DOCUMENTS 3,602,392 A 8/1971 Cote
3,894,681 A 7/1975 Arneson et al.
3,961,706 A 6/1976 Roccaforte et al.
4,318,474 A 3/1982 Hasegawa
4,331,289 A 5/1982 Killy
4,334,644 A 6/1982 Hauser
4,364,509 A 12/1982 Holley, Jr. et al.
4,378,877 A 4/1983 Botterman et al.
4,396,143 A 8/1983 Killy
4,417,655 A 11/1983 Forbes, Jr.
4,498,581 A 2/1985 Dutcher
4,577,762 A 3/1986 Kuchenbecker
4,577,799 A 3/1986 Oliff
4,605,128 A 8/1986 Rieke
4,785,991 A 11/1988 Schuster
4,871,067 A 10/1989 Valenti
4,890,440 A 1/1990 Romagnoli
4,949,845 A 8/1990 Dixon
4,974,731 A 12/1990 Wood
4,974,771 A 12/1990 Lavery
5,137,211 A 8/1992 Summer et al.
5,219,229 A 6/1993 Sengewald
5,368,194 A 11/1994 Oliff et al.
5,427,242 A 6/1995 Oliff et al.
5,482,185 A 1/1996 McNaughton
5,505,372 A 4/1996 Edson et al.
5,518,111 A * 5/1996 Stout ..... 206/427
5,577,612 A 11/1996 Chesson et al.
5,622,309 A 4/1997 Matsuda et al.
5,657,872 A 8/1997 Leftwich et al.
5,664,683 A 9/1997 Brody
5,690,213 A 11/1997 Matsumura
5,772,030 A 6/1998 Baxter
5,826,783 A 10/1998 Stout
5,875,961 A 3/1999 Stone et al.
5,881,884 A 3/1999 Podosek
5,921,398 A 7/1999 Carroll
5,924,559 A 7/1999 Carrel et al.
6,176,419 B1 1/2001 Holley, Jr.
6,283,293 B1 9/2001 Lingamfelter
6,409,077 B1 6/2002 Telesca et al.
D459,927 S 7/2002 Flowers et al.
6,478,219 B1 11/2002 Holley, Jr.
6,484,903 B2 11/2002 Spivey et al.
6,550,615 B2 4/2003 Lingamfelter
6,557,699 B1 5/2003 Focke et al.
6,578,736 B2 6/2003 Spivey
6,669,083 B2 12/2003 Bates
6,715,639 B2 4/2004 Spivey
6,752,262 B1 6/2004 Boriani et al.
6,789,673 B2 9/2004 Lingamfelter
6,902,104 B2 6/2005 Holley, Jr. et al.
6,918,487 B2 7/2005 Harrelson
6,929,172 B2 8/2005 Bates et al.
6,991,107 B2 1/2006 Harrelson
6,997,316 B2 2/2006 Sutherland
7,004,897 B2 2/2006 Spivey, Sr.
7,048,817 B1 5/2006 Hammond
7,100,798 B2 9/2006 Spivey
7,104,435 B2 9/2006 Holley, Jr.
7,134,551 B2 11/2006 Harrelson
7,237,674 B2 7/2007 Auclair
7,467,713 B2 12/2008 Harrelson
7,614,497 B2 11/2009 Spivey, Sr.
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2003/0141313 A1 7/2003 Bates
2003/0150759 A1 8/2003 White, Jr.
2004/0060972 A1 4/2004 Harrelson
2004/0089575 A1 5/2004 Lingamfelter
2004/0089671 A1 5/2004 Miller
2004/0099558 A1 5/2004 Oliff et al.
2004/0155098 A1 8/2004 Harrelson
2004/0188277 A1 9/2004 Auclair
2004/0188300 A1 9/2004 Sutherland
2005/0023170 A1 2/2005 Lingamfelter
2005/0092820 A1 5/2005 Chekroune
2005/0126947 A1 6/2005 Holley, Jr.
2006/0175386 A1 8/2006 Holley, Jr.

FOREIGN PATENT DOCUMENTS

FR 2 549 010 A1 1/1985
GB 2264101 8/1993
JP 49-18843-01 2/1974
JP 55-61519 5/1980
JP 59-147018 10/1984
JP 60-190680 12/1985
JP 63-111422 7/1988
JP 2000-50947 2/2000
WO WO 96/29260 9/1996
WO WO 99/64301 12/1999
WO WO 00/03937 1/2000
WO WO 02/30785 4/2002
WO WO 2004/043790 A2 5/2004
WO WO 2005/037663 A1 4/2005

* cited by examiner

DISPENSING SYSTEM FOR DOUBLE STACK CARTON

CROSS-REFERENCE TO RELATED APPLICATION

This application is a continuation of U.S. patent application Ser. No. 11/558,717, filed Nov. 10, 2006, now U.S. Pat. No. 7,467,713, which application is a continuation of U.S. patent application Ser. No. 11/139,827, filed May 27, 2005, now U.S. Pat. No. 7,134,551, which is a continuation of U.S. patent application Ser. No. 10/365,148, filed Feb. 12, 2003, now U.S. Pat. No. 6,918,487, which are hereby incorporated herein by reference in their entirety.

BACKGROUND OF THE INVENTION

1. Field of the Invention

The present invention relates generally to an enclosed paperboard carton capable of enclosing containers in two tiers, which carton has a unique opening and dispensing feature that allows the containers, for example, cans, to be removed or dispensed one container per tier at a time without destroying the overall structural integrity of the carton. The unique opening and dispensing feature can be incorporated in cartons containing a plurality of layers of containers stacked on end and still limit the dispensing to one container per tier at a time.

2. Background

Fully enclosed cartons capable of enclosing cans have been used in the past that have a feature for dispensing the cans one at a time. Dispensers have been provided at various locations on these cartons depending on the design.

Cartons have been introduced into the marketplace that can carry 24 or more containers, for example cans, in two stacks or tiers. So far no satisfactory dispenser has been developed for dispensing the layers of cans in these two stack cartons one at a time from each stack or tier. Consequently, when these cartons are opened they tend to let a number of the cans roll out which has not allowed these twin stack cartons to achieve their full potential.

3. Prior Art

U.S. Pat. No. 3,265,283 to Farquhar discloses a fully enclosed carton having a dispenser for dispensing the enclosed cans. The end wall of the carton has a dispensing flap which can be folded down upon opening. An aperture formed by the flap extends into the side walls to permit grasping of the can to withdraw it from the carton. When the flap is opened, the cans are held in the carton by an arcuate flap portion extending downwardly in the end wall into the center of the aperture. The structural integrity of this carton is compromised because the entire bottom end of the carton is opened. It will be realized that the design of this dispenser is not satisfactory for dispensing containers, for example cans, that are stacked in twin stacks in a carton.

U.S. Pat. No. 4,364,509 to Holly, Jr. et al. also discloses a fully enclosed carton with a dispenser in one of the end walls. This dispenser is likewise formed in the end wall by tearing out an end flap and lowering it into proper position. Expansion slits are provided in the side wall for the user's fingers to grasp the ends of the existing can. The dispenser of this carton is not satisfactory for use in a twin stack carton for carrying containers.

SUMMARY OF THE INVENTION

It is an object of this invention to develop a dispenser for dispensing containers, for example cans, one at a time from a carton containing containers in two stacks or tiers. It is the further object of this invention to develop a dispenser that can be easily opened. A further object of this invention is to develop a dispenser that can be used for containers stacked in a 3 by 4 configuration in each stack to be dispensed one at a time from each stack without the containers rolling out accidentally. A final object of this invention is to develop a dispenser for a twin stack carton that does not destroy the structural integrity of the carton when it is opened.

Briefly described, in its preferred form, the objects of this invention are achieved by providing an enclosed carton for carrying containers in two tiers for dispensing the containers one at a time from each tier from the exiting end of the carton. The carton is generally rectangular and has a bottom, top, two sides, a closed end and exiting end. The carton is foldably constructed from a blank having panels and flaps. The carton is designed to carry containers, e.g. cans, that are stacked on their ends in two tiers from the bottom panel to the top panel. The dispenser is constructed by providing tear lines in one of the side panels that extend into the exiting end of the carton which is rested on the other side panel, with the dispenser being capable of dispensing the containers as they are resting on their sides. A tear line is provided in the end of the carton placed from the side upon which the carton rests while dispensing containers at a sufficient distance to prevent any of the containers below the top layer of containers from rolling out of the carton when the dispenser is open. A pair of tear lines extend from this bottom tear line from each end at an angle from the bottom tear line to the top side panel in which part of the dispenser is formed. The angle and distance of the projection is such as to restrain the top layer of cans in each tier from accidentally rolling out. The dispenser is constructed with a large enough opening in the top side panel in which it is formed to permit a person to grasp and remove a container in each tier one at a time.

This carton can be designed with a dispenser dispensing containers in a 3 by 4 configuration in each tier. The bottom tear line is located so as to prevent the bottom layers of containers from rolling out of the carton. A pair of tear lines extending from the ends of the bottom tear line are placed at an angle designed to restrain containers in the top layer from rolling out of the carton.

Because a carton for carrying 24 containers is placed under a great deal of stress, the top panel can be constructed from two handle flaps having a reinforcing strip attached to the inside handle flap folded over against the inside of the carton between the two oval handle apertures carrying the carton.

To facilitate holding the containers and dispensing them one at a time a divider may be provided between each tier of containers.

To facilitate opening the carton dispenser, a pull tab can be provided in the side panel where part of the dispenser is located, with the pull tab being loosely attached to the panel, but tightly attached to the dispenser for opening the dispenser.

Preferably the exiting end of the carton has four flaps for closing this end. An end flap attached to the side of the carton on which it is resting while the containers are being dispensed is generally not removed and serves to restrain one or more of the bottom layers of containers from rolling out of the carton. Preferably the tear lines in the end flaps attached to the top panel, and bottom panel are constructed so that a portion of each of these flaps is not removed and are glued to the flap attached to the side panel on which the carton rests during dispensing to preserve the integrity of the carton.

Other objects, features and advantages of this invention will become apparent upon reading the following specification, when taken in conjunction with the accompanying drawings.

DETAILED DESCRIPTION OF THE PREFERRED EMBODIMENTS

Figure 1:
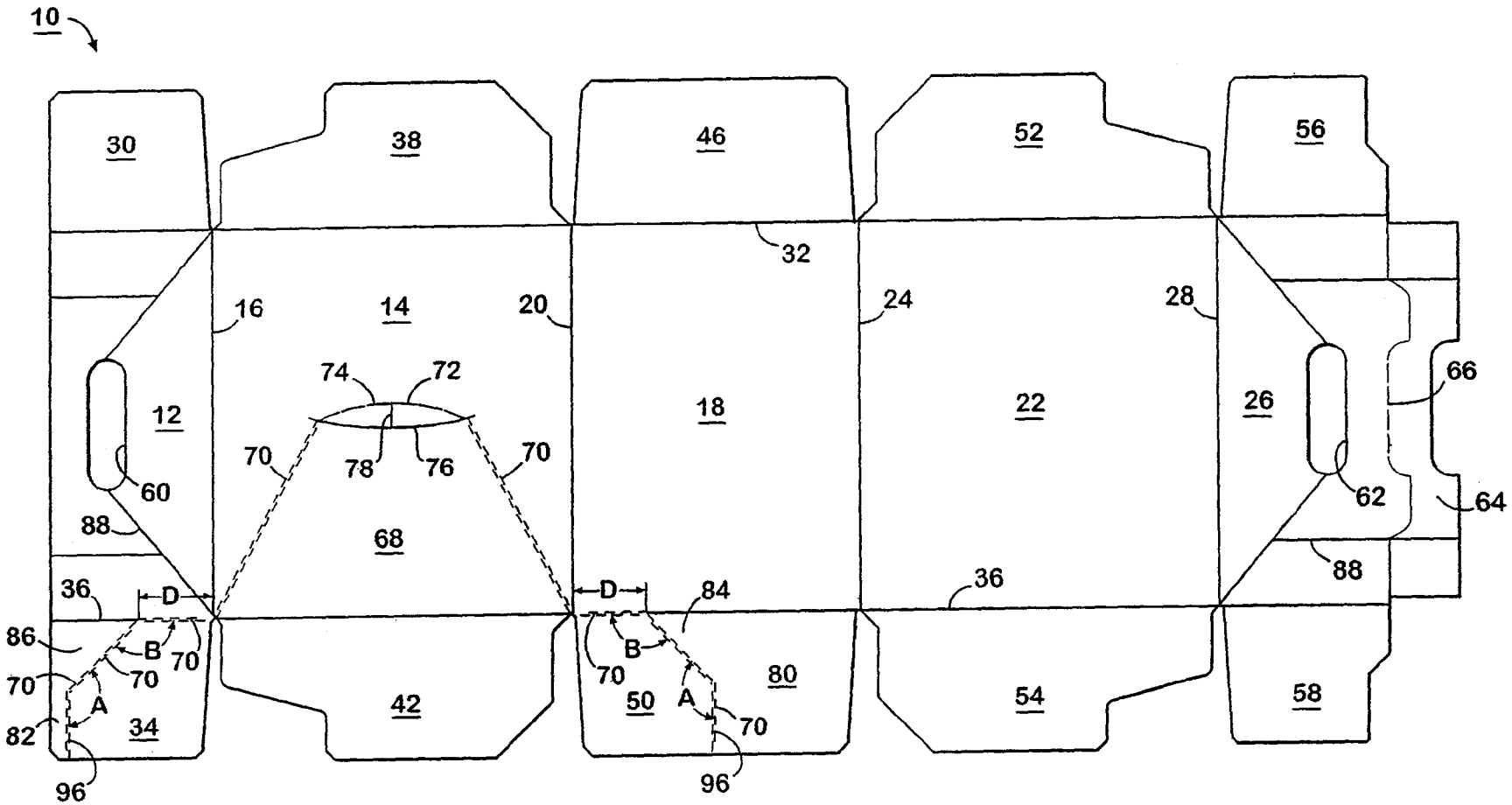
FIG. 1 is a plan view of the blank of the preferred embodiment of this invention from which a carton is formed.

The present invention is intended primarily for use with cans of the types used to contain soft drinks, beer and the like. The blank 10 is formed from a foldable sheet of material, such a paperboard. The blank 10 has an outside handle flap 12 which is attached to the top side panel 14 by fold line 16 which in turn is attached to bottom panel 18 by fold line 20, which in turn is attached to bottom side panel 22 by fold line 24. Bottom side panel 22 is foldably attached to inside handle flap 26 by fold line 28. The carton is supplied with a number of end flaps for closing the ends of the carton. The outside handle flap 12 is attached to outside top end flap 30 by fold line 32 and outside handle flap 12 is attached to outside top end flap 34 by fold line 36. Top side flap 38 is attached to top side panel 14 by fold line 32. Top side panel 14 is attached to top side flap 42 by fold line 36. Bottom panel 18 is attached to bottom end flap 46 by fold line 32 and to bottom end flap 50 by fold line 36. Bottom side panel 22 is attached to bottom side flap 52 by fold line 32 and to bottom side flap 54 by fold line 36. Inside handle flap 26 is attached to inside top end flap 56 by fold line 32 and to the inside top end flap 58 by fold line 36.

This carton has a pair of race track handles 60 and 62 formed in outside handle flap 12 and inside handle flap 26 respectively. Because this carton is designed to carry 24 containers, such as cans, it is provided with a handle reinforcing flap 64 attached to inside handle flap 26 by fold line 66.

A dispensing flap 68 is partially formed in top side panel 14 by tear line 70. To facilitate opening this dispenser, a pull tab 72 is provided to facilitate opening the dispensing flap 68. The pull tab 72 is loosely attached to top side panel 14. Pull tab 72 has a slit 74 between it and top side panel 14 to ease pulling of the pull tab from the plane of top side panel 14. Pull tab 72 is attached to dispensing flap 68 by fold line 76. A slit 78 may be provided in the middle of pull tab 72 to ease its removal from top side panel 14.

It will be understood by those skilled in the art that the carton of the present invention is generally symmetrical about a horizontal line of bisection, as viewed when FIG. 1 is rotated lengthwise. This symmetry aids in the efficient production of the present carton.

Figure 7:
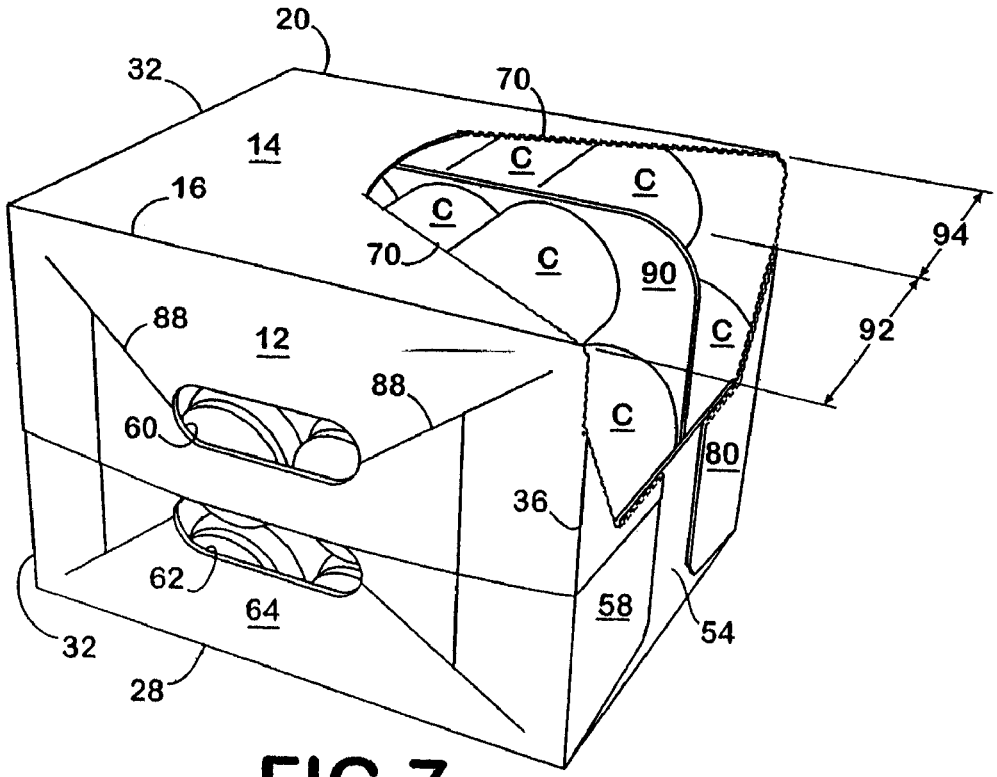
FIG. 7 is a perspective end view of the carton of FIG. 6 showing that a can has been removed from the top tier and from the bottom tier of cans.

In forming this blank 10 into a carton, the handle reinforcing flap 64 is folded along fold line 66 and glued to the inside handle flap 26. The blank 10 is then folded so that outside handle flap 12 is glued to inside handle flap 26 so that the two oval handles 60 and 62 are parallel to each other. These steps result in forming a carton sleeve in which cans can be loaded in the bottling plant. The cans can be placed in two tiers of a 3 by 4 configuration. This is best illustrated in FIG. 7 which shows the top tier 92 located near the top of the carton and the bottom tier 94 located near the bottom of the carton. In order to maintain the two tiers of cans in proper alignment during loading and when dispensed to the consumer, a divider 90 may be necessary. The divider 90 can be made out of a single sheet of paperboard.

After the two tiers of cans have been loaded into the carton various end flaps on both ends are closed and glued. To use the end of the carton where the dispenser is located as an example, the top side flap 42 is folded inwardly, bottom side flap 54 is folded inwardly, bottom end flap 50 is folded in an overlapping position, and glued to top side flap 42 and bottom side flap 54. Outside top end flap 34 and inside top end flap 58 are glued together to form a single top end flap which is likewise glued to top side flap 42 and bottom side flap 54. The other end of the carton is closed in the same manner.

When the dispenser is opened, dispensing flap 68, which includes top side flap 42, is removed from the carton along with a portion of outside end flap 34 and bottom end flap 50 along tear line 70. In order to preserve the structural integrity of the carton after the dispenser has been opened, it is important that end retention panel 82 be glued to inside top end flap 58 which in turn is glued to bottom side flap 54. Otherwise, the end retention projection 86 will not be firmly attached to carton. It is likewise important that end retention panel 80 be glued to bottom side flap 54 in order to ensure that end retention projection 84 is firmly attached to the carton after the dispenser is opened.

It should be realized that dispensers could be placed on both ends of the carton, but preferably it is only placed on one end. Cans can be removed from the exiting end of the carton after tear line 70 has been torn. The pair of tear lines 70 converge towards each other towards pull tab 72. Tear line 70 extends along fold line 36 between bottom end flap 50 and bottom, or second, panel 18 for a distance D and turns at an angle B and turns again at angle A to form a portion of bottom tear line 96. On the other side of top side, or first, panel 14, tear line 70 extends to fold line 36 and extends along that line and turns into the interior of outside top end flap 34 at angle B until it turns to form bottom line 96 at angle A.

Figure 2:
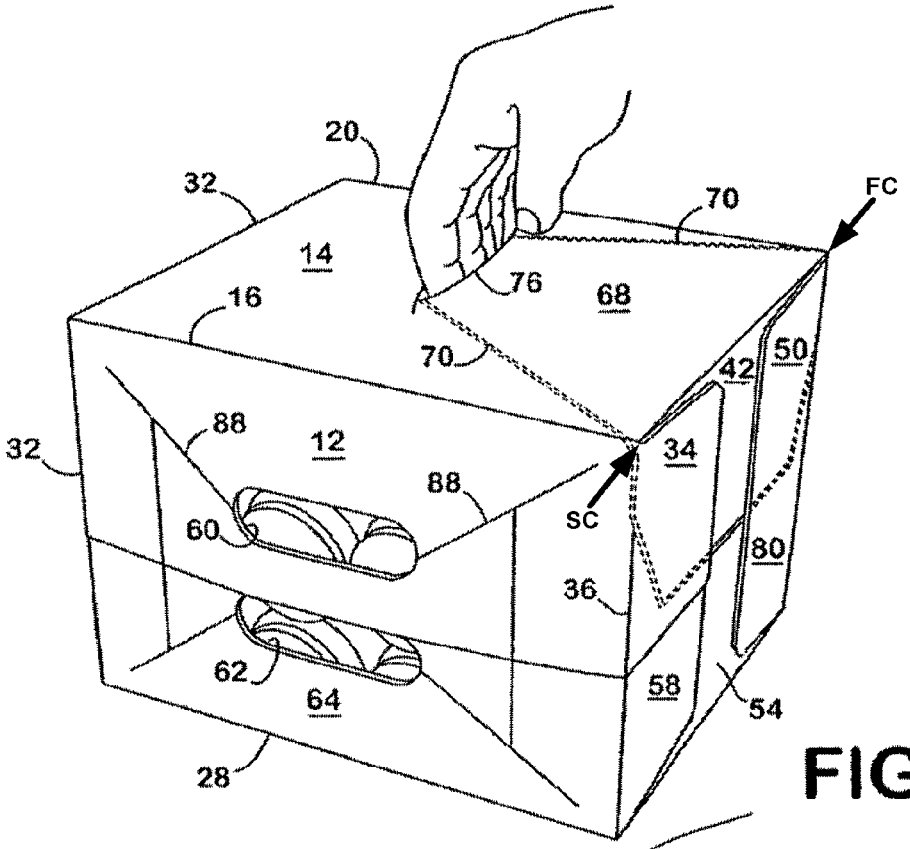
FIG. 2 is a perspective top view of the carton of the preferred embodiment loaded with two tiers of cans in a 3 by 4 configuration in each tier with a person starting to open the dispenser.
Figure 3:
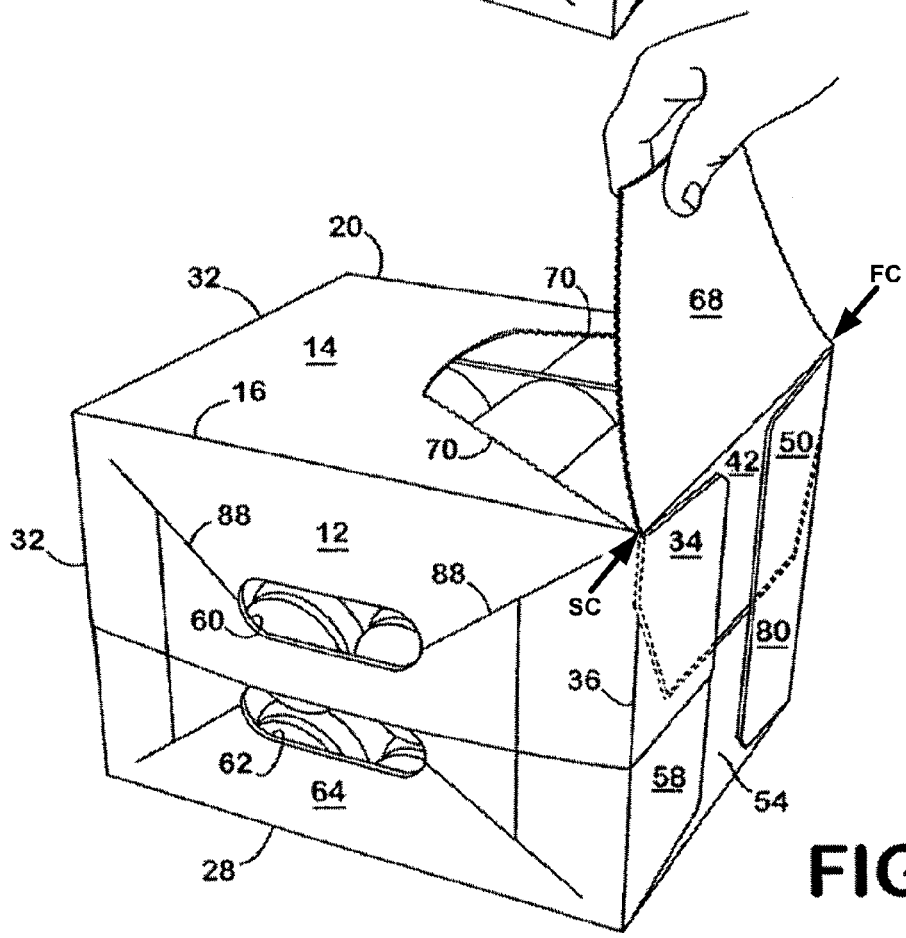
FIG. 3 is a perspective top view of the carton with a dispenser pulled part way open.
Figure 4:
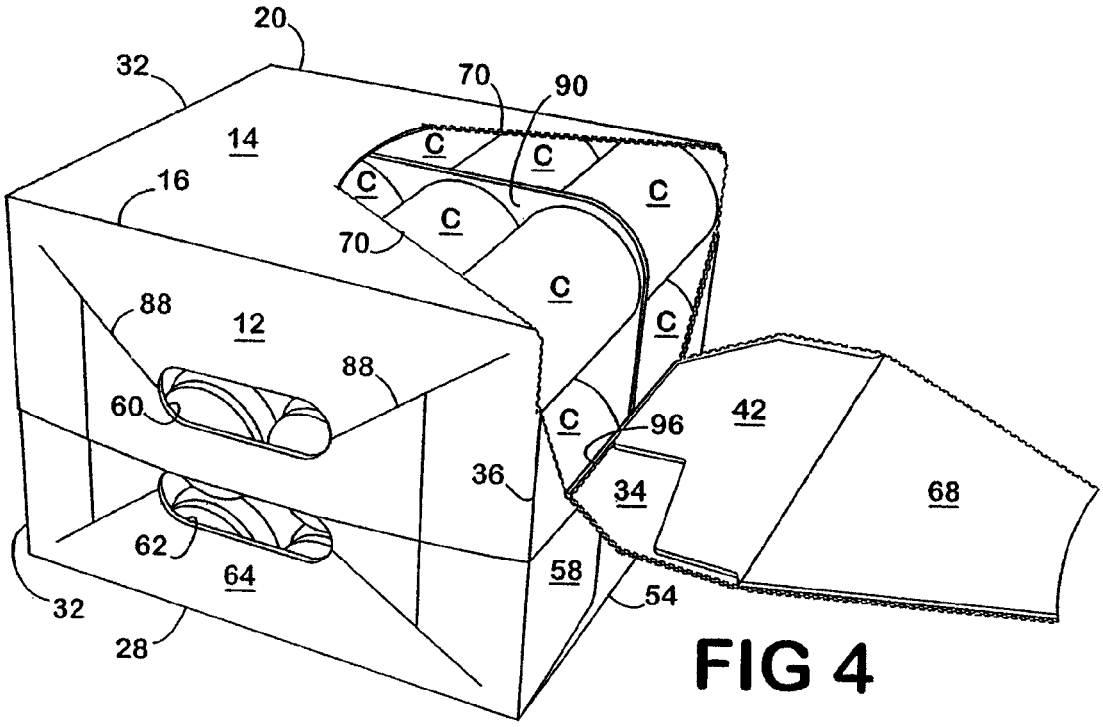
FIG. 4 is a perspective end view of the carton with cans in each tier in a 3 by 4 configuration with the dispenser being opened except for the bottom tear line.
Figure 5:
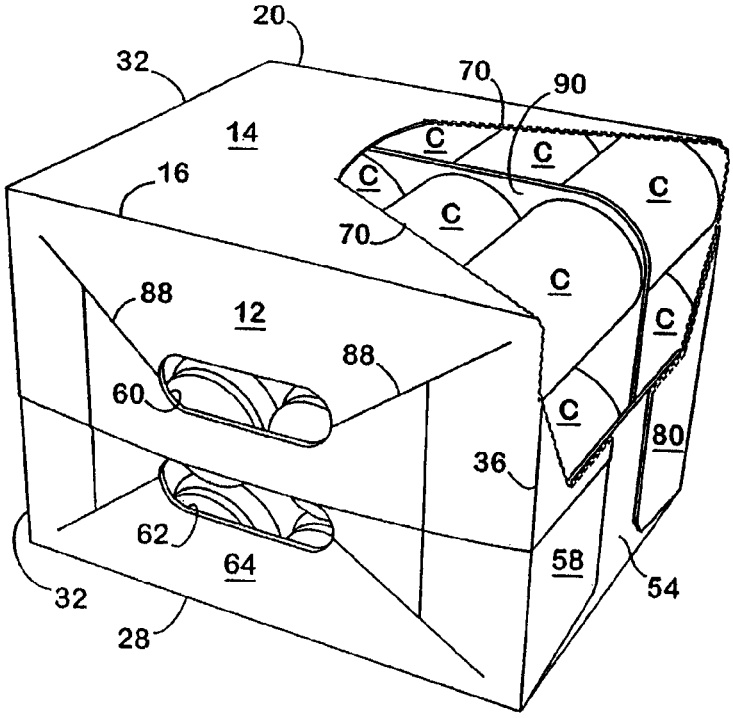
FIG. 5 is perspective end view of the carton loaded with two tiers of cans in a 3 by 4 configuration with the dispenser completely removed but all the cans being contained in the carton.

The consumer can open dispensing flap 68 by inserting his or her fingers into pull tab 72 which is an easy maneuver because of slit 74. In place of slit 74, a tear line that is loosely attached to top side panel 14 may be substituted in lieu of the slit. Insertion of the fingers into the aperture formed by depressing pull tab 72 is illustrated in FIG. 2. It will be noticed that the carton has been turned 90° so that it rests on bottom side, or fourth, panel 22. Outside handle flap 12 and inside handle flap 26 form the top, or third, panel. As shown in FIGS. 2-3, the first panel 14, second panel 18, and the exiting end meet at a first corner FC, and the first panel 14, third panel 12, 26, and the exiting end meet at a second corner SC. As shown in FIGS. 2-7, one of the pair of tear lines 70 that converge towards each other extends from the first corner FC into first panel 14 and the other of the pair of tear lines 70 that converge towards each other extends from the second corner SC into first panel 14. The consumer proceeds to pull pull tab 72 upward which is connected by fold line 76 to dispensing flap 68 which is pulled up as illustrated in FIG. 3. Continued tearing open of the dispenser is illustrated in FIG. 4. The dispenser is opened along tear line 70 which extends on both sides so that the dispensing flap 68 is torn open along fold line 36 and into the interior of outside top end flap 34 and bottom end flap 50 as illustrated in FIG. 4. The tearing continues down to the point where tear line 70 forms bottom tear line 96 which has not yet been torn as shown in FIG. 4. FIG. 5 illustrates a complete removal of the dispenser by tearing along bottom tear line 96. Even though the entire dispenser has been removed in FIG. 5, the cans are retained in the carton even though the cans are lying on their sides. The bottom two layers of cans in the 3 by 4 configuration are prevented from rolling out of the carton by bottom side flap 54 to which end retention panels 80 and 82 are glued. It will be noticed that bottom side flap 54 only extends part way up the diameter of the cans in the second layer of the three tiers. The top layer of cans in the two tiers is prevented from rolling out by end retention projections 84 and 86. Tear line 70 only extends along fold line 36 a distance D which is slightly less than the diameter of the top layer of cans being contained. This is sufficient to prevent the top layer of cans from rolling out of the carton but yet not prevent an obstacle to their easy removal by the consumer. Tear line 70 turns at an angle B and then turns again at angle A to form the bottom tear line 96 on both outside top end flap 34 and bottom end flap 50. It will be realized that end retention projections 84 and 86 are helpful in retaining the top layer of cans in the carton. The extent of this help depends upon the location of the bottom tear line 96 in relation to the layers of cans C.

Figure 6:
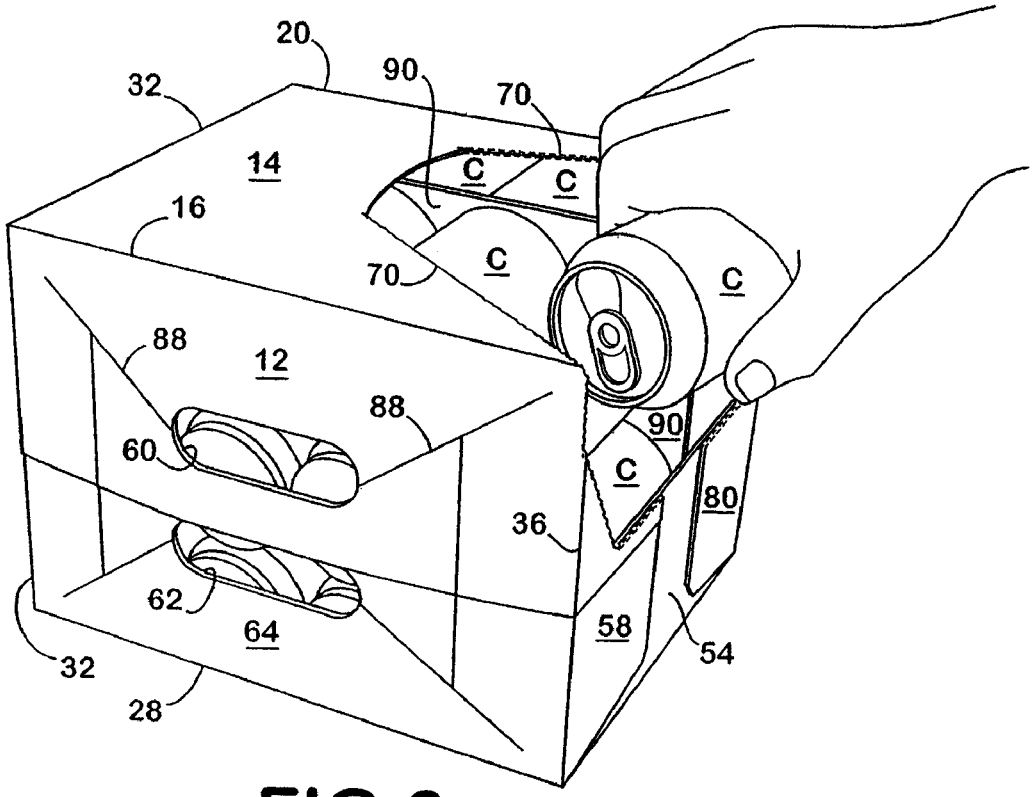
FIG. 6 is a perspective end of the carton of FIG. 5 showing a person removing a can from the top tier of cans.

FIG. 6 illustrates a consumer removing a can from the top tier 92 of cans C. It will be noticed that the consumer moves a can by twisting it slightly along its longitudinal axis and removing the bottom end of the can C first as it easily slides along the divider 90. It is necessary to remove the can in this way as the top of the can is retained in position by end retention projection 86. The end retention projections 84 and 86 are important as it is desirable that the cans in the top layer not roll out when the dispenser is open. The divider 90 and end retention projections 84 and 86 are designed to ensure that the top layer of cans adjacent the dispenser not roll out accidentally. FIG. 7 illustrates a carton with cans from each tier having been removed with the remaining cans held in place.

Because the blank 10 is designed to carry 24 cans in two tiers, it will be appreciated that the carton is heavy when loaded with cans. It is preferred that the top panel be composed of an outside handle flap 12 and an inside handle flap 26 and handle reinforcing flap 64 be utilized. In addition, stress lines 88 that are designed to dissipate the stress posed by lifting the carton handle 60 and 62 can be utilized. It should be realized that the carton sleeves can be glued together at other locations but is preferred to be glued at the top panel.

It will be noticed that the tear lines 70 in top side panel 14 converge towards each other and extend away from fold line 36 to provide a large enough opening when dispensing flap 68 is removed to permit a person to grasp cans in the top layer in each tier near the exiting end of the carton.

A carton for carrying cans is preferred that these containers have ends that are of the same diameter as the body of the container.

UNIQUE FEATURES OF THE DISPENSER OF THIS INVENTION

One of the unique features of the dispenser of this invention is that it permits the easy dispensing of containers that are stacked in two tiers. The carton is unique in that it carries the containers in their upright position, but dispenses them when the containers are on their side. Placement of the bottom tear line in the dispenser will restrain all but the top layer of containers from rolling out. An angled projection on each side of the dispenser can be utilized to prevent the top layer of containers from rolling out. The provision of a divider is important in maintaining the configuration of the containers into two tiers during loading and dispensing.

While the invention has been disclosed in its preferred forms, it will be apparent to those skilled in the art that many modifications, additions, and deletions can be made therein without departing from the spirit and scope of the invention and its equivalents as set forth in the following claims.

What is claimed is:

1. A package comprising:

a carton enclosing a plurality of containers;

the carton comprising:

two ends including an exiting end;

four panels connected to the two ends, the four panels including a first panel connected to a second panel the first panel connected to a third panel, and a fourth panel opposite the first panel; the first panel, the second panel, and the exiting end meet at a first corner; the first panel, the third panel, and the exiting end meet at a second corner;

a first panel flap connected to the first panel along a first fold line, a second panel flap connected to the second panel, a third panel flap connected to the third panel, and a fourth panel flap connected to the fourth panel; the first panel flap, the second panel flap, the third panel flap, and the fourth panel flap form the exiting end;

a dispensing flap at the exiting end; the dispensing flap including a first section and a second section; the first section and the second section being connected along the first fold line; the first section being defined at least partially by the first fold line; the second section being defined at least partially by the first fold line, a first tear line, and a second tear line; the first tear line extending at least partially along and collinear with a second fold line;

wherein the first section is defined at least partially by a third tear line and a fourth tear line; the third tear line extending from the first corner and the fourth tear line extending from the second corner;

wherein the dispensing flap extends from the first corner to the second corner in the first panel and in the exiting end;

wherein the third tear line and the fourth tear line converge towards each other from the first corner and the second corner, respectively, to at least partially define the first section; and wherein all the containers are retained in the carton when the dispensing flap is separated along the first tear line.

2. The package of claim 1, further including a pull tab formed in the first panel.

3. The package of claim 1 wherein each container has an axis and wherein the axes of said plurality of containers are arranged in the carton parallel to the first panel.

4. The package of claim 1 wherein the first section is detachable along the third tear line and fourth tear line, and the second section is detachable along the first tear line and the second tear line.

5. The package of claim 1 wherein the third tear line does not extend along the first fold line; and wherein the fourth tear line does not extend along the first fold line.

6. The package of claim 5 wherein the first section extends from the first corner to the second corner.

7. The package of claim 1 wherein the first section extends from the first corner to the second corner.

8. The package of claim 1 wherein the containers are cans.

9. The package of claim 1 wherein the dispensing flap is capable of being hinged along the second section.

10. The package of claim 9 wherein the dispensing flap is capable of being detached from the carton.

11. The package of claim 1 wherein the dispensing flap is capable of being detached from the carton.

12. The package of claim 1 wherein the second tear line extends at least partially along and collinear with a third fold line.

13. The package of claim 12 wherein the second tear line extends from the second corner along the third fold line; and wherein the second section of the dispensing flap is detachable along the second tear line.

14. A package comprising:

a carton and a plurality of containers;

the carton comprising:

four panels connected to two ends, the two ends including an exiting end; the four panels including a first panel connected to a second panel, a third panel connected to the first panel, and a fourth panel opposite the first panel; the first panel being connected to the exiting end along a first fold line; the first panel, the second panel, and the exiting end meet at a first corner; the first panel, the third panel, and the exiting end meet at a second corner;

a dispensing flap at the exiting end; the dispensing flap including a first section and a second section; the first section and the second section being connected along the first fold line; the first section being defined at least partially by the first fold line; the second section being defined at least partially by the first fold line, a first tear line, and a second tear line; the first tear line extending from the first corner at least partially along and collinear with a second fold line;

wherein the first section is defined at least partially by a third tear line and a fourth tear line; the third tear line extending from the first corner and the fourth tear line extending from the second corner;

wherein the third tear line is not collinear with the first fold line;

wherein the fourth tear line is not collinear with the first fold line;

wherein the third tear line and the fourth tear line converge towards each other from the first corner and the second corner, respectively, to at least partially define the first section; and wherein all the containers are retained in the carton when the dispensing flap is separated along the first tear line.

15. The package of claim 14 wherein each container has an axis and wherein the axes of said plurality of containers are arranged in the carton parallel to the first panel.

16. The package of claim 14 including means for facilitating separation of the dispensing flap.

17. The package of claim 16 wherein the means is a pull tab that is spaced from the first fold line.

18. The package of claim 14 wherein the containers are cans that are positioned in rows and columns.

19. The package of claim 14 wherein the dispensing flap includes an entirety of the first fold line.

20. The package of claim 14 wherein the first tear line extends from the first corner.

21. The package of claim 14 wherein the third tear line extends from the first corner to a means for facilitating separation of the dispensing flap.

22. The package of claim 21 wherein the means is a pull tab.

23. A carton comprising:

four panels connected to two ends; the two ends including an exiting end; the four panels including a first panel connected to a second panel, a third panel connected to the first panel, and a fourth panel opposite the first panel; the first panel being connected to the exiting end along a first fold line; the first panel, the second panel, and the exiting end meet at a first corner; the first panel, the third panel, and the exiting end meet at a second corner;

a dispensing flap at the exiting end; the dispensing flap including a first section and a second section; the first section and the second section being connected along the first fold line; the first section being defined at least partially by the first fold line; the second section being defined at least partially by the first fold line, a first tear line, and a second tear line; the first tear line extending from the first corner at least partially along and collinear with a second fold line;

wherein the first section is defined at least partially by a third tear line and a fourth tear line; the third tear line extending from the first corner and the fourth tear line extending from the second corner;

wherein the third tear line is not collinear with the first fold line;

wherein the fourth tear line is not collinear with the first fold line; and, wherein the third tear line and the fourth tear line converge towards each other from the first corner and the second corner, respectively, to at least partially define the first section.

24. The carton of claim 23 wherein the dispensing flap includes an entirety of the first fold line.

25. The carton of claim 24 wherein the first section extends from the first corner to the second corner.

26. The carton of claim 23 wherein the first section extends from the first corner to the second corner.

27. The carton of claim 23 wherein the carton encloses containers and wherein all the containers are retained in the carton when the dispensing flap is detached along the first tear line and the second tear line.

28. The carton of claim 27 wherein the containers are cans.

29. The carton of claim 23 wherein the dispensing flap is capable of being hinged along the second section.

30. The carton of claim 29 wherein the dispensing flap is capable of being detached from the carton.

31. The carton of claim 23 wherein the dispensing flap is capable of being detached from the carton.

32. The carton of claim 23 wherein the second tear line extends at least partially along and collinear with a third fold line.

33. The carton of claim 32 wherein the second tear line extends from the second corner along the third fold line; and wherein the second section of the dispensing flap is detachable along the second tear line.

* * * * *

US007780003C1

(12) EX PARTE REEXAMINATION CERTIFICATE (9910th)

United States Patent
Harrelson

(10) Number: US 7,780,003 C1
(45) **Certificate Issued: *Oct. 25, 2013**

(54) DISPENSING SYSTEM FOR DOUBLE STACK CARTON

(75) Inventor: Glen R. Harrelson, Gainesville, GA (US)

(73) Assignee: Bank of America, N.A., San Francisco, CA (US)

Reexamination Request:
No. 90/012,455, Aug. 28, 2012

Reexamination Certificate for:

| | |
|---|---|
| Patent No.: | **7,780,003** |
| Issued: | **Aug. 24, 2010** |
| Appl. No.: | **12/274,477** |
| Filed: | **Nov. 20, 2008** |

( * ) Notice: This patent is subject to a terminal disclaimer.

Related U.S. Application Data

(63) Continuation of application No. 11/558,717, filed on Nov. 10, 2006, now Pat. No. 7,467,713, which is a continuation of application No. 11/139,827, filed on May 27, 2005, now Pat. No. 7,134,551, which is a continuation of application No. 10/365,148, filed on Feb. 12, 2003, now Pat. No. 6,918,487.

(51) Int. Cl.

| | |
|---|---|
| ***B65D 75/00*** | (2006.01) |
| ***B65D 17/00*** | (2006.01) |
| ***A47F 1/04*** | (2006.01) |

(52) U.S. Cl.
USPC ..... 206/427; 221/305; 229/122; 229/242

(58) Field of Classification Search
None
See application file for complete search history.

(56) References Cited

To view the complete listing of prior art documents cited during the proceeding for Reexamination Control Number 90/012,455, please refer to the USPTO's public Patent Application Information Retrieval (PAIR) system under the Display References tab.

*Primary Examiner* — Jeffrey R Jastrzab

(57) ABSTRACT

The carton of this invention is capable of carrying the plurality of containers stacked upon their ends in two tiers with a unique dispenser that permits the dispensing of containers on their sides. The dispenser is formed in a top side wall and extends into the end wall with most of the end wall being torn open but leaving a portion near the bottom side wall to prevent the bottom layer of containers from rolling out. Angled projections in the dispensing end of the carton near the top panel and bottom panel prevent the top layer of containers from rolling out. A divider may be inserted between the two tiers of containers to facilitate loading the carton and preventing the containers from accidentally rolling out when the dispenser is open.

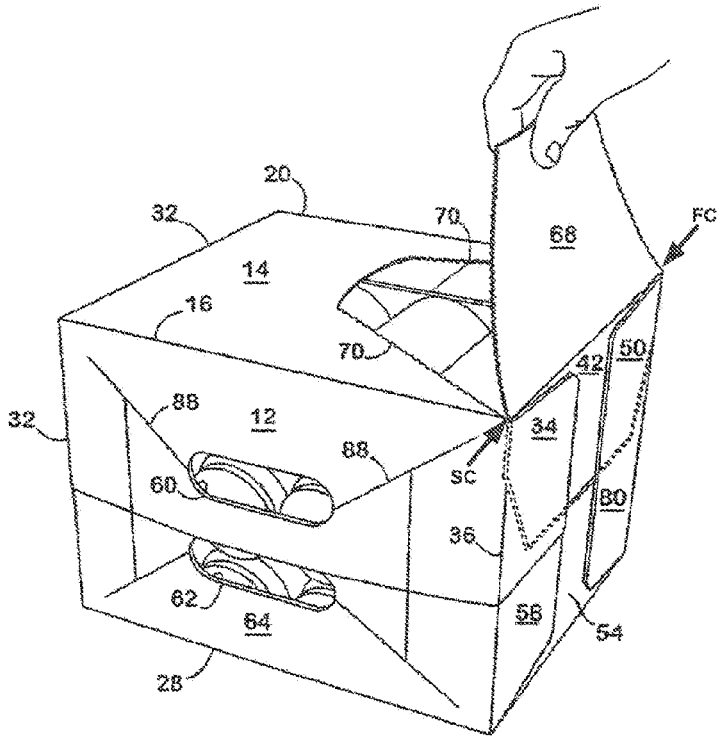

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1-33 are cancelled.

* * * * *